US010876548B2

(12) United States Patent
Ting

(10) Patent No.: US 10,876,548 B2
(45) Date of Patent: Dec. 29, 2020

(54) CENTRIFUGAL FAN STRUCTURE

(71) Applicants: Inventec (Pudong) Technology Corporation, Shanghai (CN); INVENTEC CORPORATION, Taipei (TW)

(72) Inventor: Kuo-Chi Ting, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 660 days.

(21) Appl. No.: 15/475,154

(22) Filed: Mar. 31, 2017

(65) Prior Publication Data

US 2018/0142707 A1 May 24, 2018

(30) Foreign Application Priority Data

Nov. 21, 2016 (CN) ..... 2016 1 1039134

(51) Int. Cl.

| | |
|---|---|
| ***F01D 5/00*** | (2006.01) |
| ***F04D 29/66*** | (2006.01) |
| ***F04D 17/16*** | (2006.01) |
| ***F04D 29/02*** | (2006.01) |
| ***F04D 29/42*** | (2006.01) |

(52) U.S. Cl.

CPC ..... *F04D 29/665* (2013.01); *F04D 17/16* (2013.01); *F04D 29/023* (2013.01); *F04D 29/4226* (2013.01)

(58) Field of Classification Search

CPC ... F04D 29/4226; F04D 29/281; F04D 29/422
USPC ..... 415/119
See application file for complete search history.

(56) References Cited

U.S. PATENT DOCUMENTS

| | | | | |
|---|---|---|---|---|
| 8,100,642 | B2 * | 1/2012 | Hwang | F04D 29/464 415/206 |
| 8,534,998 | B2 * | 9/2013 | Liang | F04D 29/4246 415/182.1 |
| 9,341,195 | B2 * | 5/2016 | Wang | F04D 29/703 |
| 10,273,963 | B2 * | 4/2019 | Santucci | F04D 25/0693 |
| 2013/0177402 | A1 * | 7/2013 | Horng et al. | F28G 13/00 415/121.2 |
| 2014/0119909 | A1 * | 5/2014 | Chiang | F04D 17/105 415/208.1 |

* cited by examiner

*Primary Examiner* — Long T Tran
*Assistant Examiner* — James J Kim
(74) *Attorney, Agent, or Firm* — CKC & Partners Co., LLC

(57) ABSTRACT

The disclosure provides a centrifugal fan structure. The centrifugal fan structure includes a top case, a body, a fan, and a muffler pipe. The top case includes an air inlet. The body includes a sidewall, a tongue part, and a bottom case. The sidewall and the tongue part are disposed on the bottom case. The sidewall includes an opening. The fan is disposed in the body, and includes a shaft and a plurality of fan blades connected to the shaft. The muffler pipe is disposed on the sidewall, and the opening of the muffler pipe is corresponding to the opening of the sidewall. The length of the muffler pipe is proportional to the wavelength of the blade passing frequency of the fan.

18 Claims, 8 Drawing Sheets

CENTRIFUGAL FAN STRUCTURE

CROSS-REFERENCE TO RELATED APPLICATION

This application claims priority to Chinese Application Serial Number 201611039134.X, filed Nov. 21, 2016, which is herein incorporated by reference.

BACKGROUND OF THE INVENTION

Field of Invention

The present disclosure relates to a centrifugal fan structure. More particularly, the present disclosure relates to a centrifugal fan structure with muffler pipe.

Description of Related Art

With the advancement of technologies, electronic devices, such as PCs, laptops, and industrial computers, have been remarkably improved in performance. However, the improvement of performance brings along with high temperature that may deteriorate the performance of the devices. At present, most of the typical electronic devices dissipate heat through a fan structure of a dissipating module. However, the fan structure of the electronic devices also produces noise, which results from blade passing frequency of the fan structure. Generally, the noise may be suppressed by modifying the shape of the blades or the flow channels, but such modification is costly and time-consuming and may affect the performance of the devices.

Thus, a simple and convenient method must be created to overcome the above issues.

SUMMARY OF THE INVENTION

The present disclosure provides a centrifugal fan structure having a top case, a body, a fan, and a muffler pipe. The muffler pipe is disposed on a sidewall of the body, and an opening of the muffler pipe corresponds to an opening of the sidewall. Since a channel of the body has stable and concentrated airflow, the air is desirably directed into the muffler pipe disposed on the sidewall so as to reduce the noise from blade passing frequency.

The muffler pipe of the present disclosure may be a quarter-of-wavelength pipe. From a destructive interference between an incident wave and a reflective wave, noise reduction is able to be achieved.

The muffler pipe may include rigid materials, such that the airflow may be completely reflected without being destroyed. The muffler pipe may include flexible materials, such that the muffler pipe may be slightly bended to fit an insufficient space in a computer.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
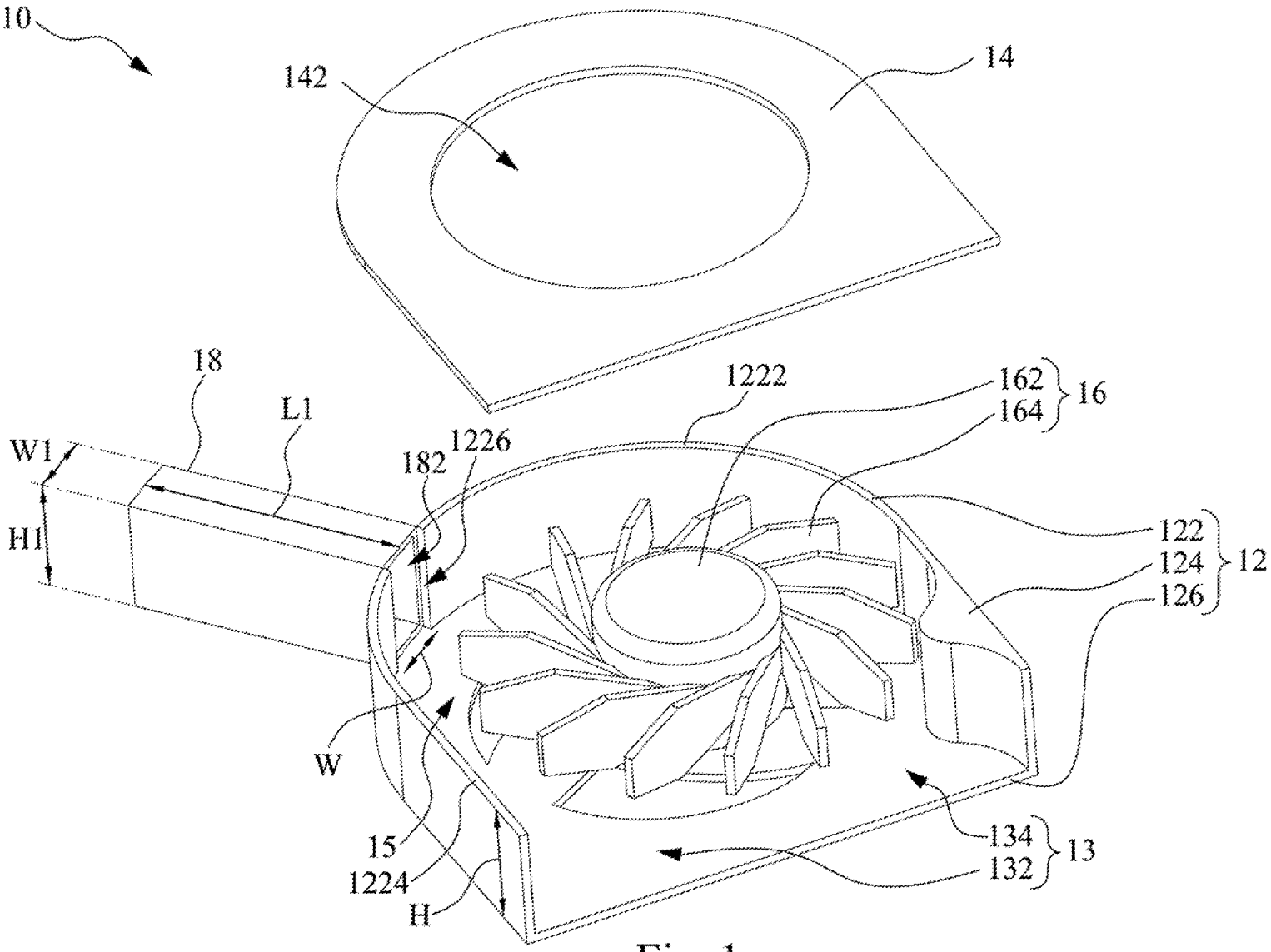
FIG. 1 is a perspective view of a centrifugal fan structure according to some embodiments of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a perspective view of a centrifugal fan structure according to some embodiments of the present disclosure. The centrifugal fan structure 10 includes a top case 14, a body 12, a fan 16, and a muffler pipe 18. The top case 14 includes an air inlet 142 disposed near the center of the top case 14. The body 12 includes a sidewall 122, a tongue portion 124, and a bottom case 126. The sidewall 122 includes an opening 1226 thereon, and the opening 1226 separates the sidewall 122 into a first portion 1222 and a second portion 1224. The first portion 1222 is connected to the tongue portion 124, and the second portion 1224 is opposite to the tongue portion 124. The sidewall 122 and the tongue portion 124 are vertically disposed on the bottom case 126, thereby forming a space within the bottom case 126, the sidewall 122, and the tongue portion 124.

The centrifugal fan structure 10 further includes a fan 16. The fan 16 includes an shaft 162 and a plurality of blades 164 connected to the shaft 162. The fan 16 is disposed in the body 12. In detail, the fan 16 is disposed in the space formed by the sidewall 122, tongue portion 124, and the bottom case 126. In concrete, the fan 16 is connected to the bottom case 16 through the shaft 162, and is further connected to external devices, such as a power supply or a processing chip, thereby providing power to the fan 16.

In an embodiment, the fan 16 rotates counterclockwise. That is, the fan 16 rotates along the tongue portion 124, the first portion 1222, and the second portion 1224. The principle of the centrifugal fan structure 10 includes importing air through the air inlet 142 of the top case 14, and the fan 16 rotates to drive the airflow. Then, the air flows through a channel 15 between the sidewall 122 and the fan 16, and leaves from an air outlet 13. In detail, a portion of the air leaves from a near side 132 of the air outlet 13, and another portion of the air flows from the near side 132 to a rear side 134 of the air outlet 13.

More particularly, in an embodiment the fan 16 is closer to the tongue portion 124, and is away from the opposite second portion 1224 of the sidewall 122. In other words, the channel 15 has a smaller gap between the blades 164 and the tongue portion 124, but has a larger gap between the blades 164 and the second portion 1224 of the sidewall 122. Thus, the width of the channel 15 increases along the tongue portion 124, the first portion 1222, and the second portion 1224. The width variation of the channel 15 induces pressure variation, such that the air is driven in the channel and the heat may be dissipated.

The centrifugal fan structure 10 further includes a muffler pipe 18 disposed on the sidewall 122. The muffler pipe 18 includes an opening 182 for air inlet. In detail, the sidewall 122 has an opening 1226 (the gap between the first portion 1222 and the second portion 1224) at the position of the muffler pipe 18, and the opening 1226 of the sidewall 122 corresponds to the opening 182 of the muffler pipe 18. In some embodiments, the size of the opening 1226 of the sidewall 122 is substantially equal to the opening 182 of the muffler pipe 18. The muffler pipe 18 is straight, and has length L1, width W1, and height H1. In some embodiments, the height H1 of the muffler pipe 18 is substantially equal to a height H of the sidewall 122 (or the height of the opening 1226), and the width W1 of the muffler pipe 18 is substantially equal to a width W of the opening 1226.

On the other hand, the length L1 of the muffler pipe 18 depends on the blade passing frequency, which is proportional to the product of the rotation speed (times/s) of the shaft 162 and the number of the blades 164. In some embodiments, the muffler pipe 18 is referred to as a quarter-of-wavelength pipe for the length L1 of the muffler pipe 18 may be a quarter of the wavelength of the blade passing frequency. The principle of the quarter wavelength pipe is discussed below with FIGS. 1 and 2.

Figure 2:
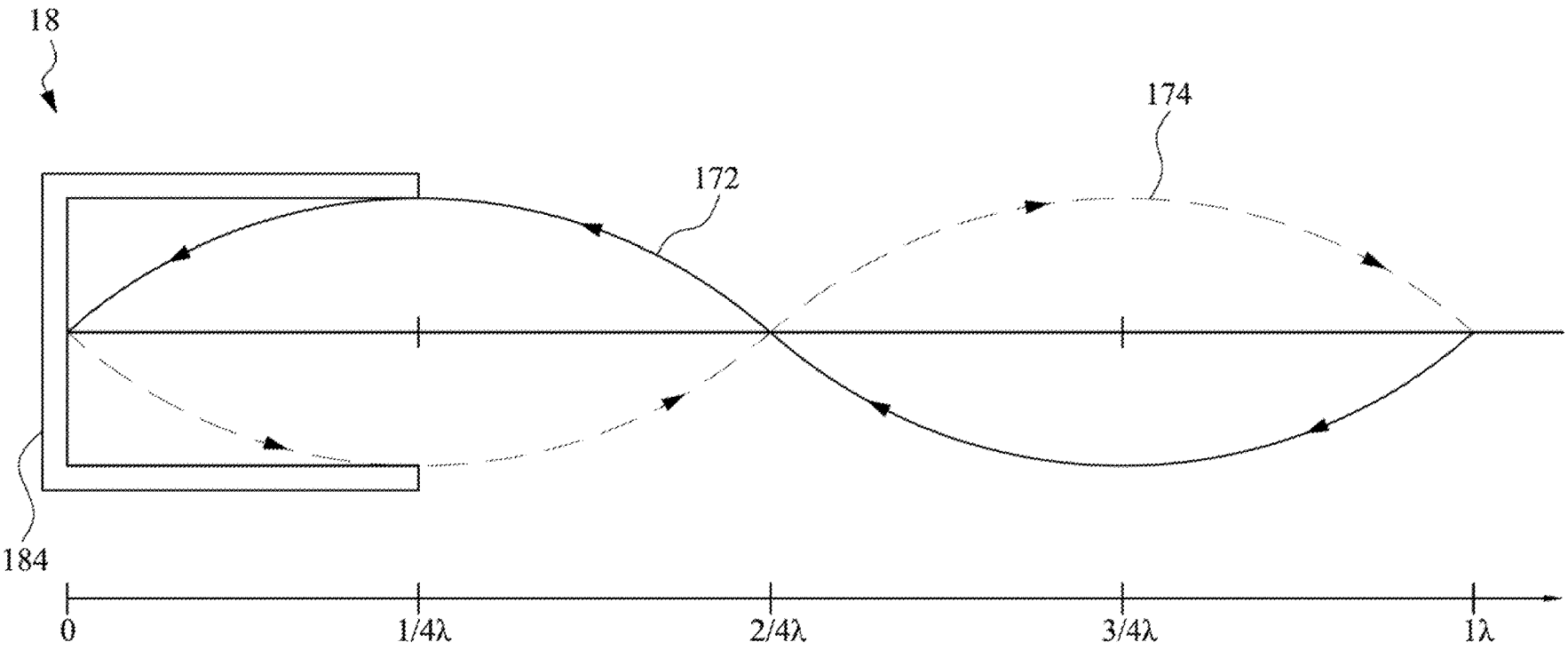
FIG. 2 is schematic view of a muffler pipe according to some embodiments of the present disclosure.

FIG. 2 is schematic view of a muffler pipe according to some embodiments of the present disclosure. An incident wave 172 is airflow caused by the rotation of the fan 16. Once the air flows into the muffler pipe 18, since the length L1 of the muffler pipe 18 is equal to quarter of the wavelength of the blade passing frequency, a reflective wave 174 having identical amplitude but opposite phase to the incident wave 172 may be generated at the end of the muffler pipe 18. Thus, the phase difference between the incident wave 172 and the reflective wave 174 may cause destructive interference, thereby reducing the noise of the blade passing frequency. In some embodiments, for example, if the blade passing frequency to be reduced is 2145 (Hz), such that the wavelength of the blade passing frequency is 343 (m/s)/2145 (Hz)=0.16 (m). The length L1 of the muffler pipe 18 is 0.16 (m)/4=0.04 (m), which is equal to quarter of the wavelength.

Referring back to FIG. 1, in some embodiments, the muffler pipe 18 and the body 12 may be formed in one piece through a mould. Since the muffler pipe 18 and the body 12 are formed in one piece, the advantage is that the muffler pipe 18 and the body 12 are formed without gap therebetween. Moreover, the muffler pipe 18 and the body 12 may be formed with identical material. For example, the muffler pipe 18 and the body 12 may include rigid or hard materials, such as plastic. Since the muffler pipe 18 with rigid materials may completely reflect an incident wave, and generate a reflective wave with identical amplitude. Thus, the muffler pipe 18 with rigid materials may have better noise reduction.

In some other embodiments, the muffler pipe 18 and the body 12 may be separated. Thus, the muffler pipe 18 may be detachably disposed at the sidewall 122 of the body 12. In some other embodiments, the muffler pipe 18 may be connected to the sidewall 122 by latch. In some other embodiments, muffler pipe 18 may be connected to the sidewall 122 by glue. Since the conventional fan structure is easy to accumulate dust, a detachable muffler pipe provides convenience for cleaning. On the other hand, the blade passing frequency may change for a long-time working, so a detachable muffler pipe may be changed to a new muffler pipe with modified length. Moreover, if the conventional fan structure does not have muffler pipe, the user may crop an opening on the sidewall and dispose a muffler pipe of the present disclosure on the conventional fan structure for noise reduction. It is noted that the lengths of the described muffler pipes all correspond to the blade passing frequency of the fan structure.

In some embodiments, the muffler pipe 18 is detachable and includes rigid material, such as plastic. In some other embodiments, the muffler pipe 18 is detachable and includes flexible material, such as rubber or flexible plastic. Since the conventional fan structures do not have enough space for accommodating a muffler pipe, a flexible or soft muffler pipe with flexibility may be easy to fit the insufficient space.

Figure 3A:
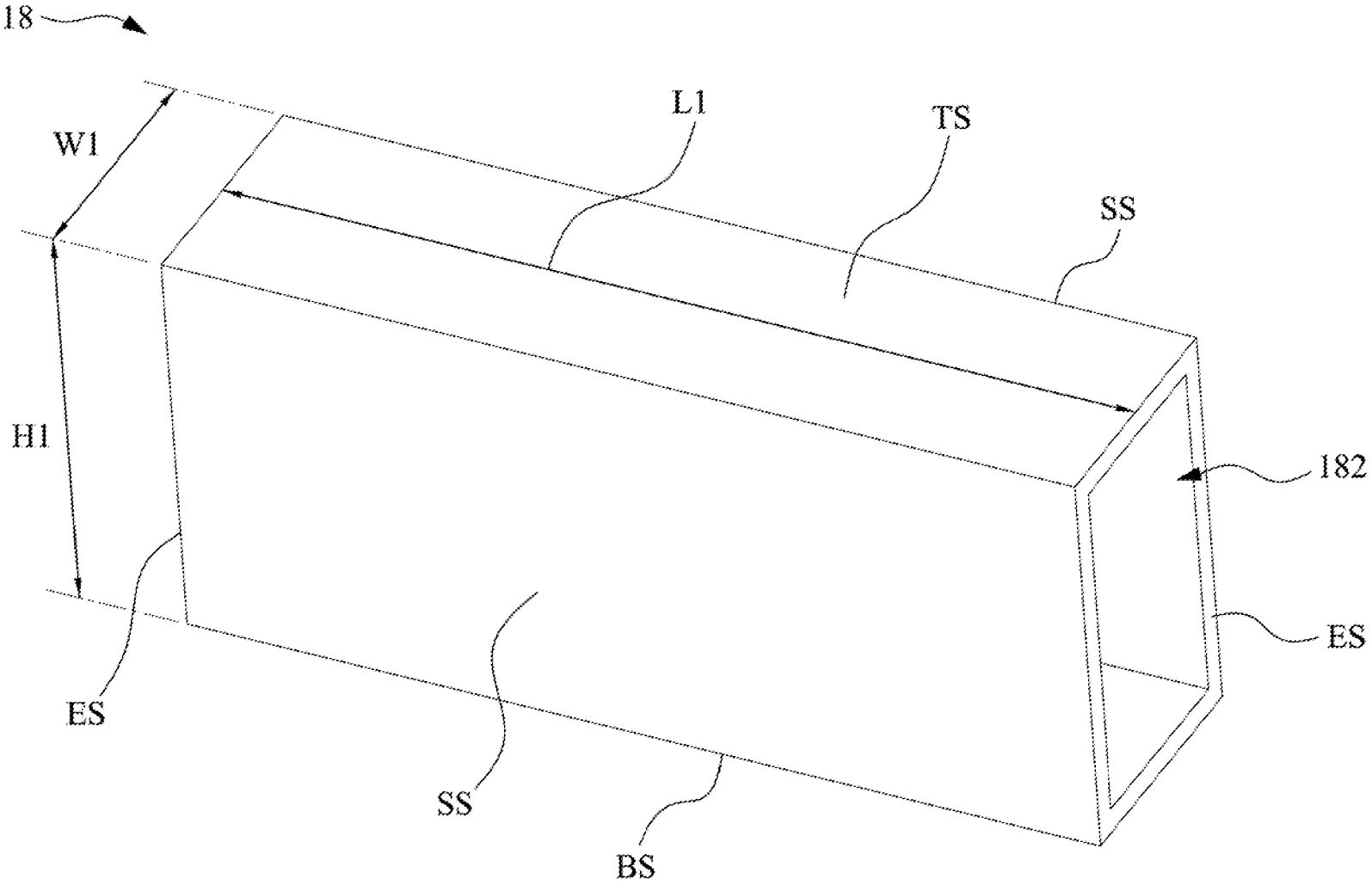
FIG. 3A is a perspective view of a centrifugal fan structure according to some embodiments of the present disclosure.
Figure 3B:
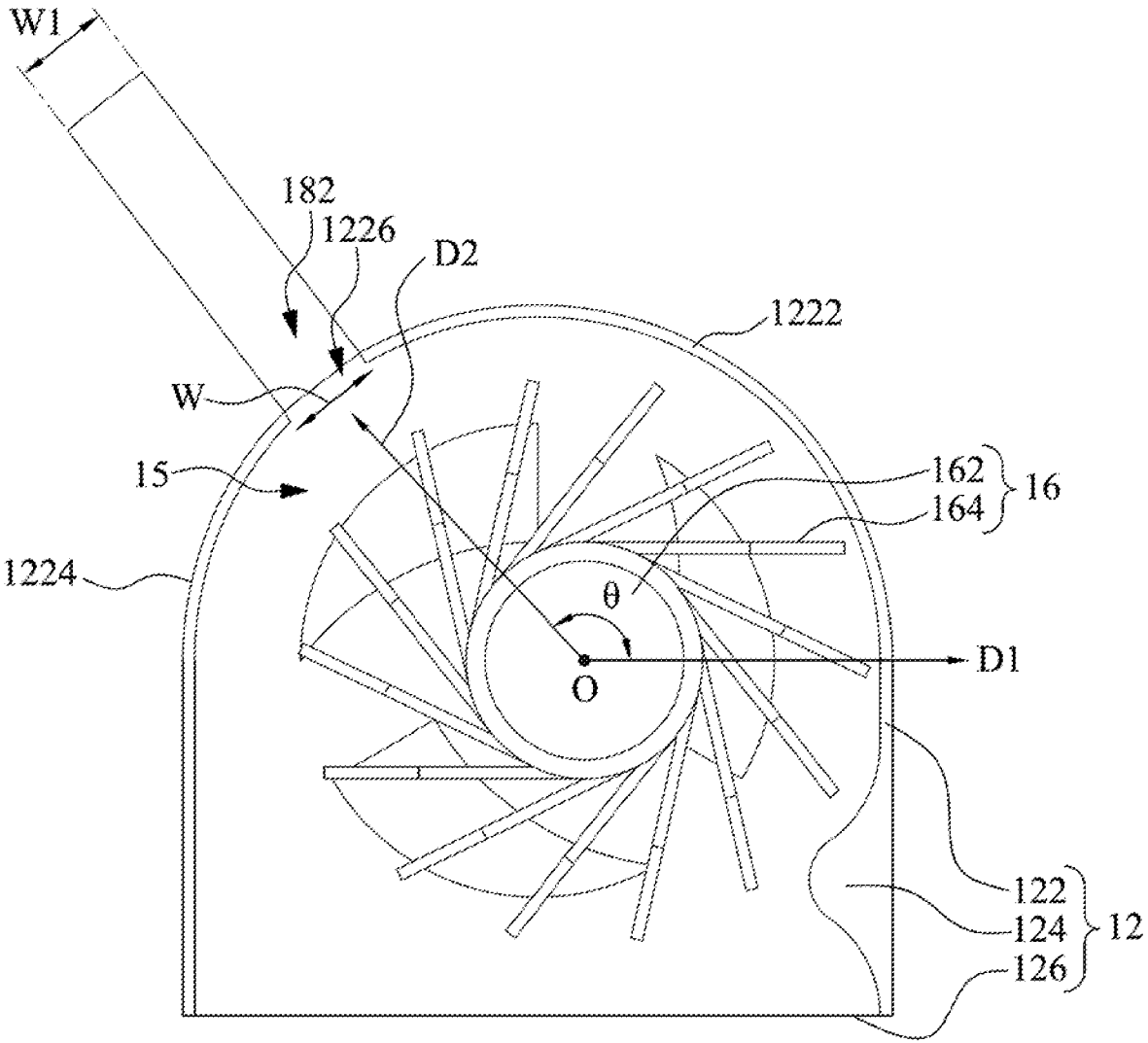
FIG. 3B is a top view of a centrifugal fan structure according to some embodiments of the present disclosure.

FIG. 3A is a perspective view of a centrifugal fan structure according to some embodiments of the present disclosure. FIG. 3B is a top view of a centrifugal fan structure according to some embodiments of the present disclosure. The muffler pipe 18 is the same as described in FIG. 1. The muffler pipe 18 is a cuboid with length L1, width W1, and height H1. The length L1 depends on the blade passing frequency of the fan. In some embodiments, the length L1 is equal to quarter of the wavelength of the blade passing frequency, and the muffler pipe 18 may also be referred to as a quarter-of-wavelength pipe. The principle of the quarter wavelength pipe is discussed in FIGS. 1 and 2.

The muffler pipe 18 has a top surface TS, a bottom surface BS, two side surfaces SS, and two end surfaces ES. The top surface TS and the bottom surface BS are disposed at a top side and a bottom side of the muffler pipe 18 along the long axis, respectively. The side surfaces SS are disposed at a left side and a right side of the muffler pipe 18 along the long axis, respectively. The end surfaces ES are disposed at a front side and a back side of the muffler pipe 18, respectively. The muffler pipe 18 further includes an opening 182 disposed at one of the end surfaces. That is, the opening 182 is disposed at one end side of the muffler pipe 18.

Referring to FIG. 3B, the centrifugal fan structure 10 includes a top case 14, a body 12, a fan 16, and a muffler pipe 18. The body 12 includes a sidewall 122, a tongue portion 124, and a bottom case 126. The sidewall 122 includes an opening 1226 thereon, and the opening 1226 separates the sidewall 122 into a first portion 1222 and a second portion 1224. The first portion 1222 is connected to the tongue portion 124, and the second portion 1224 is opposite to the tongue portion 124. The centrifugal fan structure further includes a fan 16. The fan 16 includes an shaft 162 and a plurality of blades 164 connected to the shaft 162. The fan 16 is disposed in the body 12.

In some embodiments, the muffler pipe 18 is disposed on the sidewall 122. In detail, the opening 182 of the muffler 18 corresponds to the opening 1226 of the sidewall 122, and the opening 1226 and the opening 182 have substantially the same size. The height H1 of the muffler pipe 18 is substantially equal to the height H of the sidewall 122 (as shown in FIG. 1), and the width W1 of the muffler pipe 18 is substantially equal to the width W of the opening 1226. From another view, the muffler pipe 18 is disposed on the sidewall 122, and extends away from the sidewall 122 along the length direction of the muffler pipe 18. Generally, the length direction of the muffler pipe 18 is substantially vertical to the tangent line of the opening 1226 of the sidewall 122.

The shaft 162 of the fan 16 has a center O. The center O extends to a first direction D1 along the x-axis. In the present disclosure, the first direction D1 is parallel to the bottom edge of the bottom case 126. The center O extends to a second direction D2 from the center O toward the opening 1226 of the sidewall 122. The first direction D1 and the second direction D2 define an angle θ therebetween. In some embodiments, the angle θ is 120 degree. In some other embodiments, the angle θ may be 60, 80, 100, 140 to 180 degrees, or any suitable degrees. In fact, the angle θ depends on the position of the opening 1226 of the sidewall 122.

In the present disclosure, the reason for designing the opening 1226 on the sidewall 122 and disposing the muffler pipe 18 on the sidewall 122 is: since the airflow in the channel 15 between the sidewall 122 and the fan 16 is static and concentrated, the airflow may be easily directed into the muffler pipe 18 disposed on the sidewall 122 and further reducing the noise caused by the blade passing frequency. In addition, in fabrication process, since different fans have various structures, the position of the opening 1226 may be selected according to experiment results.

In some embodiments, the muffler pipe 18 includes rigid materials, such as plastic. Since the muffler pipe 18 with rigid materials may completely reflect the incident wave and generate a reflective wave with identical amplitude, the muffler pipe 18 with rigid materials may have better noise reduction. In some other embodiments, the muffler pipe 18 is detachable and includes flexible materials, such as rubber or soft plastic. As described above, since the conventional fan structures do not have enough space for accommodating a muffler pipe, a flexible or soft muffler pipe with flexibility may be easy to fit the insufficient space.

Figure 4A:
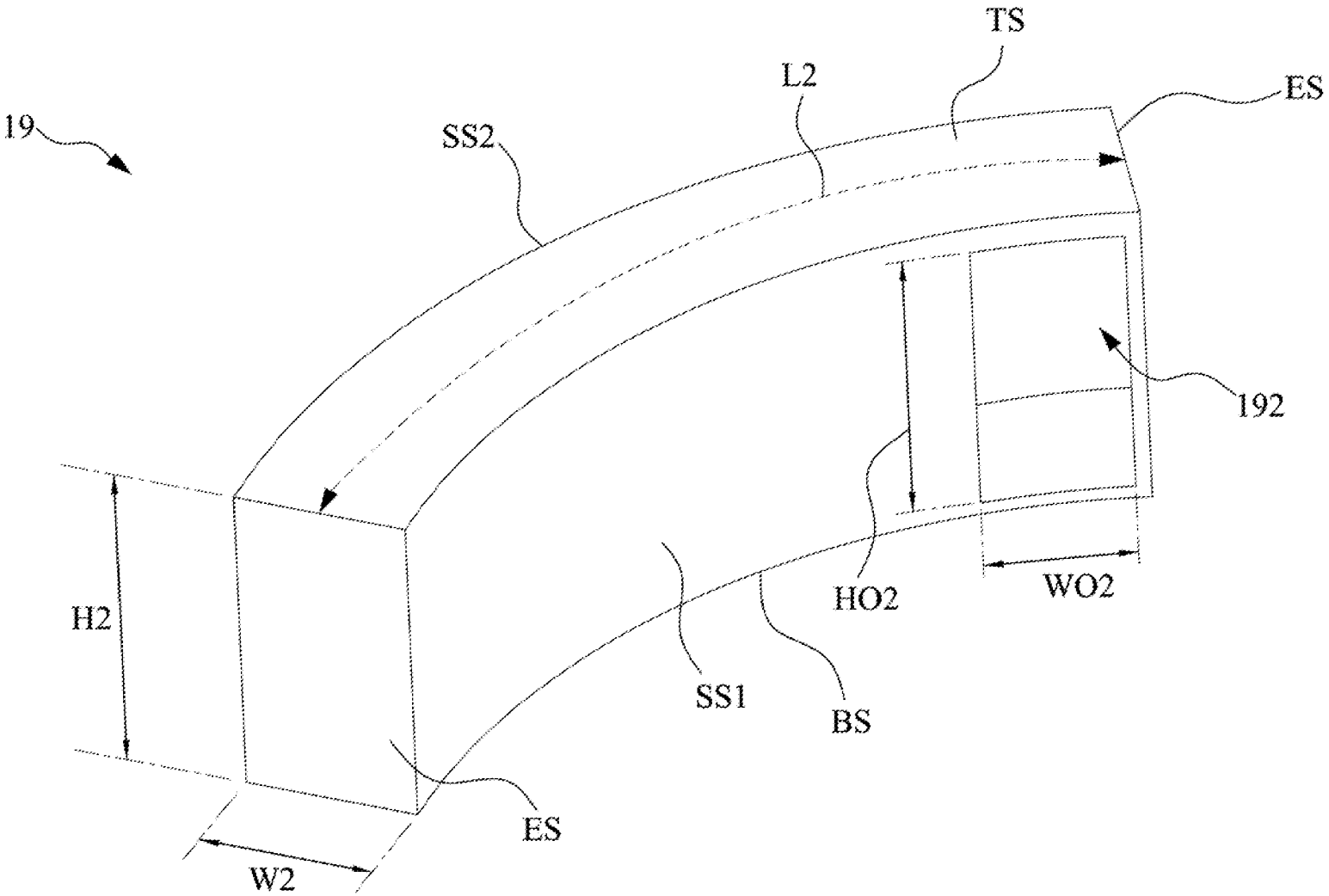
FIG. 4A is a perspective view of a centrifugal fan structure according to some embodiments of the present disclosure.
Figure 4B:
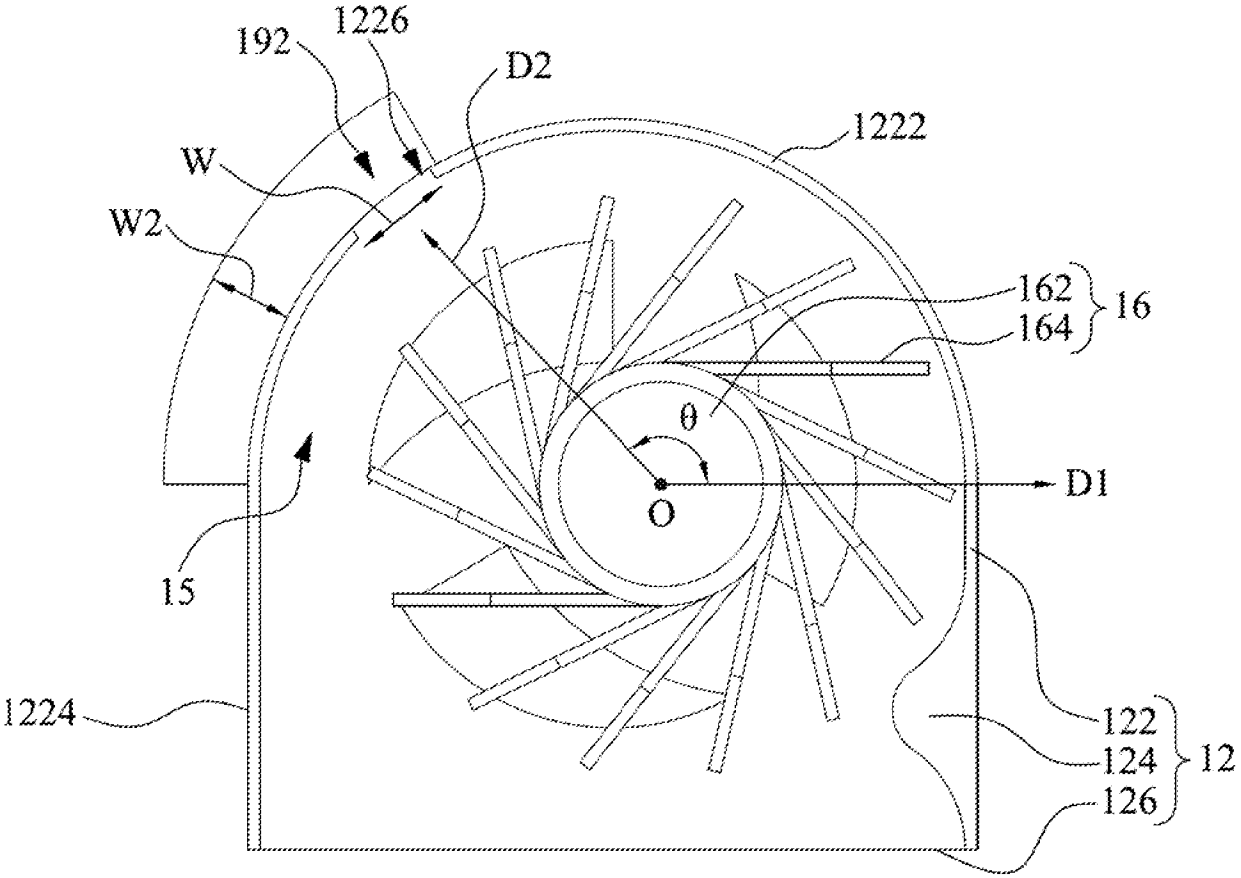
FIG. 4B is a top view of a centrifugal fan structure according to some embodiments of the present disclosure.

FIG. 4A is a perspective view of a centrifugal fan structure according to some embodiments of the present disclosure. FIG. 4B is a top view of a centrifugal fan structure according to some embodiments of the present disclosure. In the present disclosure, a muffler pipe 19 is arc shape.

The muffler pipe 19 has a top surface TS, a bottom surface BS, a long side surface SS2, a short side surface SS1, and two end surfaces ES. The top surface TS and the bottom surface BS are disposed at a top side and a bottom side of the muffler pipe 19 along the long axis, respectively. The long side surface SS2 and the short side surface SS1 are disposed at a left side and a right side of the muffler pipe 19 along the long axis, respectively. The end surfaces ES are disposed at a front side and a back side of the muffler pipe 19, respectively. The muffler pipe 19 further includes an opening 192 disposed at the short side surface SS1. In detail, the opening 192 is disposed at the edge of the short side surface SS1, in which the opening 192 is adjacent to one of the end side surface ES. Such design may provide a direct pathway in the muffler pipe 19, such that the airflow may intensively transmit in the muffler pipe 19 without dispersion. Besides, the opening 192 is rectangular, and has a width WO2 and a height HO2. In some embodiments, the width WO2 and the height HO2 of the opening 192 are substantially equal to a width W2 and a height H2 of the muffler pipe 19, respectively. That is, the size of the opening 192 is equal to the cross sectional area along the transmission direction.

The muffler pipe 19 has an average length L2, a width W2, and a height H2. The width W2 remains constant along the direction of the average length L2. That is, the vertical distance between the long side surface SS2 and the short side surface SS1 is equal to the width W2. The average length L2 depends on the blade passing frequency of the fan. In some embodiments, the average length L2 may be quarter of the wavelength of the blade passing frequency, and the muffler pipe 19 may also be referred to as a quarter-of-wavelength pipe.

Referring to FIG. 4B, the centrifugal fan structure 10 includes a top case 14, a body 12, a fan 16, and the muffler pipe 19. The body 12 includes a sidewall 122, a tongue portion 124, and a bottom case 126. The sidewall 122 includes an opening 1226 thereon, and the opening 1226 separates the sidewall 122 into a first portion 1222 and a second portion 1224. The first portion 1222 is connected to the tongue portion 124, and the second portion 1224 is opposite to the tongue portion 124. The centrifugal fan structure further includes a fan 16. The fan 16 includes an shaft 162 and a plurality of blades 164 connected to the shaft 162. The fan 16 is disposed in the body 12.

In the present embodiment, the muffler pipe 19 disposed on the sidewall 122 is arc shape and has the long side surface SS2 and the short side surface SS1. More particularly, the profile of the short side surface SS1 fits the profile of the sidewall 122. In other words, the muffler pipe 19 is disposed along the sidewall 122 for saving space. Besides, since the opening 192 of the muffler pipe 19 is disposed at the short side surface SS1 (as shown in FIG. 4A), the position of the opening 192 corresponds to the opening 1226 of the sidewall 122, such that the airflow may be directed into the muffler pipe 19 through the opening 192. Moreover, since the opening 192 is disposed at the edge of the short side surface SS1, the muffler pipe 19 is substantially disposed on the second portion 1224 of the sidewall 122. Since the air flows sequentially along the tongue portion 124, the first portion 1222, and the second portion 1224 in the channel 15, the muffler pipe 19 is substantially arranged along the direction of the airflow in the channel 15, such that the air may be smoothly directed into the muffler pipe 19 to reduce the noise.

Since the opening 192 of the muffler pipe 19 and the corresponding opening 1226 of the sidewall 122 have substantially the same size, the air may flow into the muffler pipe 19 without blocking. On the other hand, as described above, the size of the opening 192 is substantially equal to the cross sectional area of the muffler pipe 19 along the transmission direction, such that the air flowing into the muffler pipe 19 may not be unstable (i.e. in pressure or flow speed) due to the variation of the cross sectional area. Accordingly, the cross sectional area of the muffler pipe 19, the opening 192 of the muffler pipe 19, and the opening 1226 of the sidewall 122 are all associated. Thus, in fabrication process, a user can design a muffler pipe with suitable structure and opening.

The shaft 162 of the fan 16 has a center O. The center O extends to a first direction D1 along the x-axis. In the present disclosure, the first direction D1 is parallel to the bottom edge of the bottom case 126. The center O extends to a second direction D2 from the center O toward the opening 1226 of the sidewall 122. The first direction D1 and the second direction D2 define an angle θ therebetween. In some embodiments, the angle θ is 120 degree. In some other embodiments, the angle θ may be 60, 80, 100, 140 to 180 degrees, or any suitable degrees. In fact, the angle 9 depends on the position of the opening 1226 of the sidewall 122.

In the present disclosure, the reason for designing the opening 1226 on the sidewall 122 and disposing the muffler pipe 18 on the sidewall 122 is: since the airflow in the channel 15 between the sidewall 122 and the fan 16 is static and concentrated, the airflow may be easily directed into the muffler pipe 19 disposed on the sidewall 122 and further reducing the noise caused by the blade passing frequency. Besides, in fabrication process, since different fans have various structures, the position of the opening 1226 may be selected according to experiment results.

In some embodiments, the muffler pipe 19 includes rigid materials, such as plastic. Since the muffler pipe 19 with rigid materials may completely reflect the incident wave and generate a reflective wave with identical amplitude, the muffler pipe 19 with rigid or hard materials may have better noise reduction. In some other embodiments, the muffler pipe 19 is detachable and includes flexible materials, such as rubber or soft plastic. As described above, since the typical fan structures do not have enough space for accommodating a muffler pipe, a flexible or soft muffler pipe with flexibility is easy to fit the insufficient space.

Figure 5A:
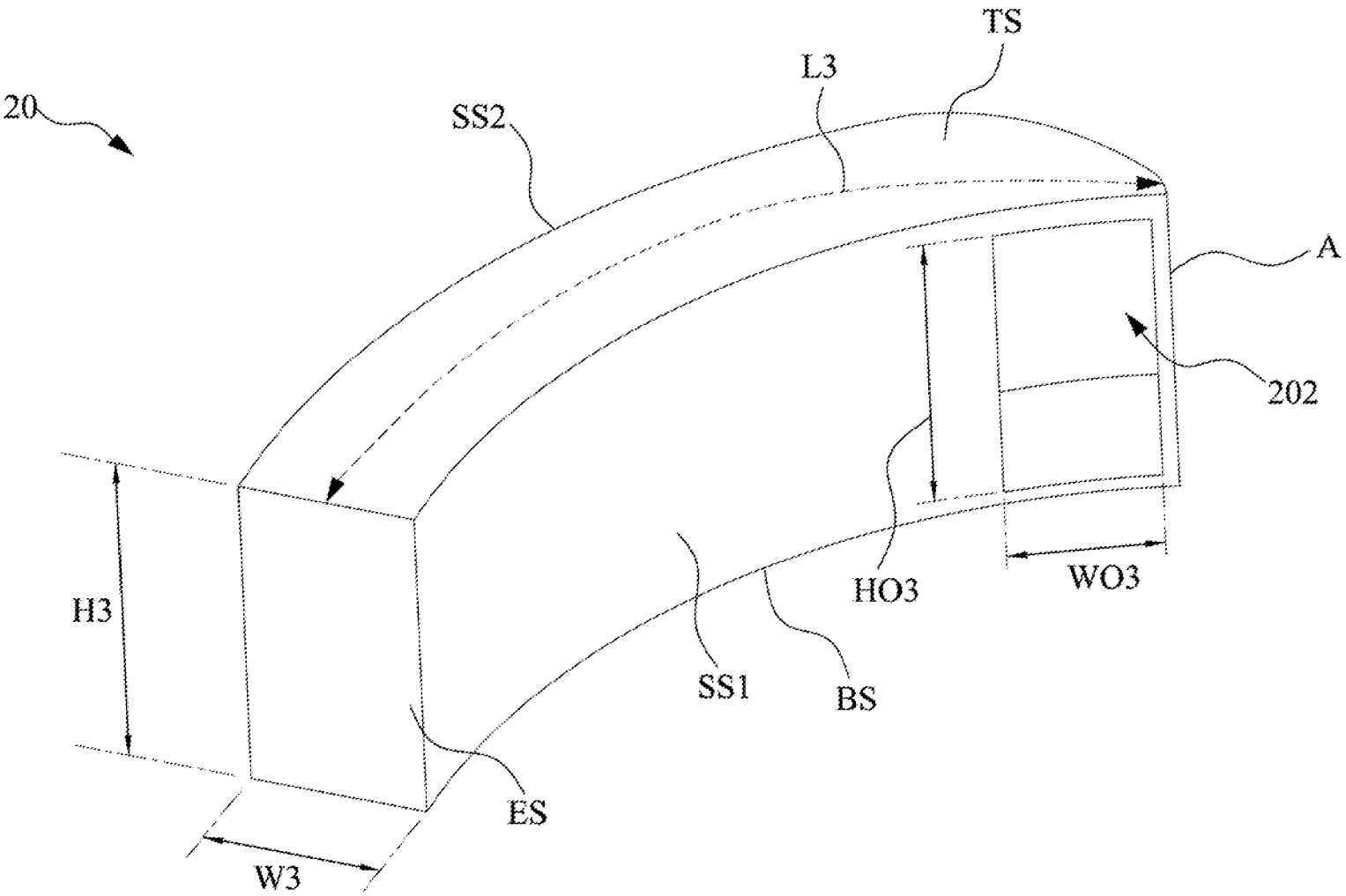
FIG. 5A is a perspective view of a centrifugal fan structure according to some embodiments of the present disclosure.
Figure 5B:
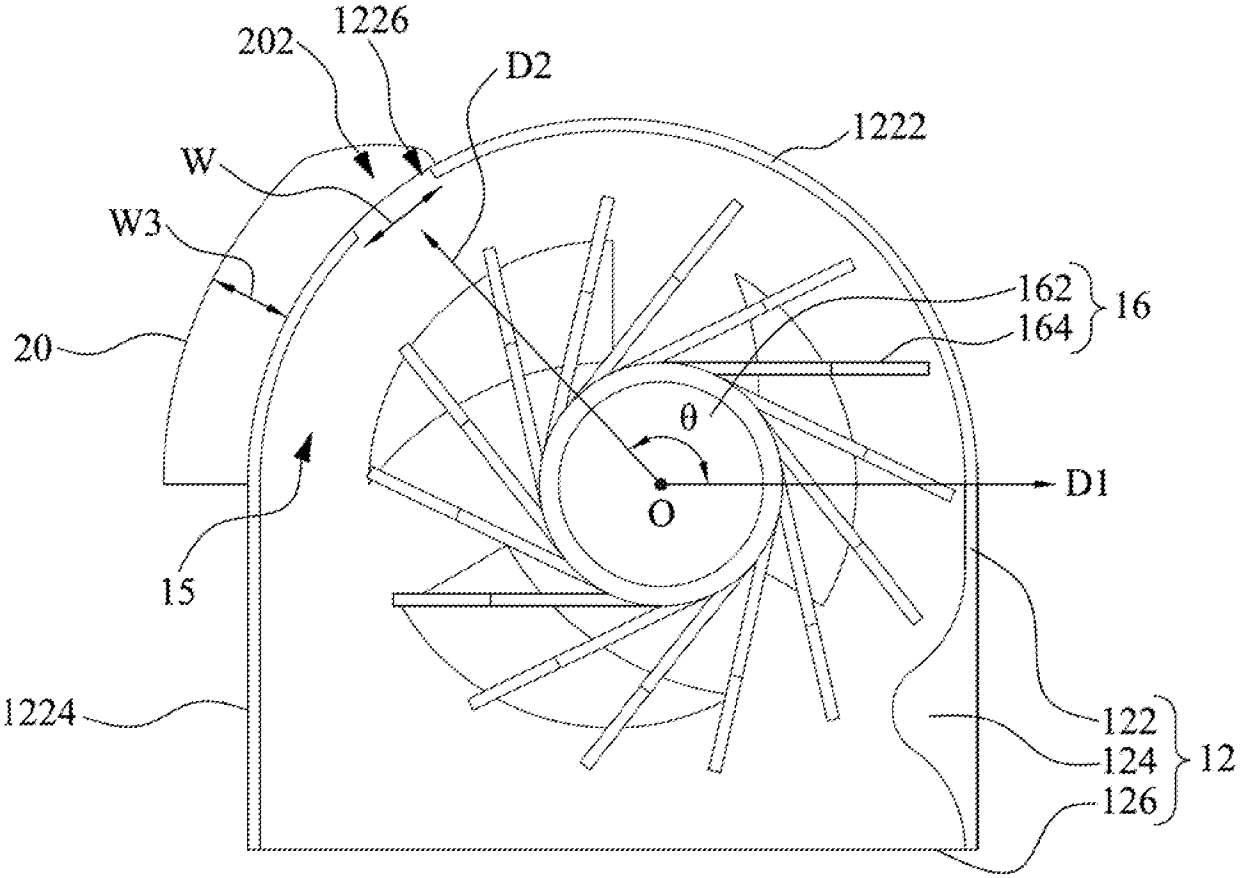
FIG. 5B is a top view of a centrifugal fan structure according to some embodiments of the present disclosure.

FIG. 5A is a perspective view of a centrifugal fan structure according to some embodiments of the present disclosure. FIG. 5B is a top view of a centrifugal fan structure according to some embodiments of the present disclosure. In the present disclosure, a muffler pipe 20 is arc shape.

The muffler pipe 20 has a top surface TS, a bottom surface BS, a long side surface SS2, a short side surface SS1, and an end surface ES. The top surface TS and the bottom surface BS are disposed at a top side and a bottom side of the muffler pipe 20 along the long axis, respectively. The long side surface SS2 and the short side surface SS1 are disposed at a left side and a right side of the muffler pipe 10 along the long axis, respectively. The end surface ES are disposed at one end of the muffler pipe 20. In detail, the long side surface SS2 and the short side surface SS1 are connected to the end side surface ES at one end of the long axis, and intersect at side A at another end of the long axis. Thus, the muffler pipe 20 has only five surfaces. The muffler pipe 20 further includes an opening 202 disposed at the short side surface SS1. In detail, the opening 202 is disposed at the edge of the short side surface SS1, in which the opening 202 is adjacent to side A. Such design may provide a direct pathway in the muffler pipe 20, such that the airflow may intensively transmit in the muffler pipe 20 without dispersion. Besides, the opening 202 is rectangular, and has a width WO3 and a height HO3. In some embodiments, the width WO and the height HO of the opening 202 are substantially equal to a width W3 and a height H3 of the muffler pipe 20. That is, the size of the opening 202 is equal to the cross sectional area along the transmission direction.

Since the long side surface SS2 and the short side surface SS1 of the muffler pipe 20 intersect at one side, the width of the muffler pipe 20 varies. The width W3 described herein indicates the maximum width of the muffler pipe 20. Generally, the muffler pipe 20 close to the side A has a smaller width. As leaving from the side A, the width gradually increases, reaching the width W3 and remaining constant hereafter. For example, in some embodiments, the width of the muffler pipe 20 increases from the side A, after passing through the opening 202 of the muffler pipe 20, the width of the muffler pipe 20 remains W3. The average length L3 of the muffler pipe 20 depends on the blade passing frequency of the fan. In some embodiments, the average length L3 may be quarter of the wavelength of the blade passing frequency, and the muffler pipe 20 may also be referred to as a quarter-of-wavelength pipe.

Referring to FIG. 5B, the centrifugal fan structure 10 includes a top case 14, a body 12, a fan 16, and the muffler pipe 20. The body 12 includes a sidewall 122, a tongue portion 124, and a bottom case 126. The sidewall 122 includes an opening 1226 thereon, and the opening 1226 separates the sidewall 122 into a first portion 1222 and a second portion 1224. The first portion 1222 is connected to the tongue portion 124, and the second portion 1224 is opposite to the tongue portion 124. The centrifugal fan structure further includes a fan 16. The fan 16 includes an shaft 162 and a plurality of blades 164 connected to the shaft 162. The fan 16 is disposed in the body 12.

In the present embodiment, the muffler pipe 20 disposed on the sidewall 122 is arc shape and has the long side surface SS2 and the short side surface SS1. More particularly, the profile of the short side surface SS1 fits the profile of the sidewall 122. In other words, the muffler pipe 20 is disposed along the sidewall 122 for saving space. Besides, since the opening 202 of the muffler pipe 20 is disposed at the short side surface SS1 (as shown in FIG. 4), the position of the opening 202 corresponds to the opening 1226 of the sidewall 122, such that the airflow may be directed into the muffler pipe 20 through the opening 202. Moreover, since the opening 202 is disposed at the edge of the short side surface SS1, the muffler pipe 20 is substantially disposed on the second portion 1224 of the sidewall 122. Since the air flows along the tongue portion 124, the first portion 1222, and the second portion 1224 in the channel 15, the transmission direction in the muffler pipe 20 is substantially in consistent with the airflow in the channel 15, such that the air may be smoothly directed into the muffler pipe 20 to reduce the noise.

Since the opening 202 of the muffler pipe 20 and the corresponding opening 1226 of the sidewall 122 have substantially the same size, the air may flow into the muffler pipe 20 without blocking. On the other hand, as described, the size of the opening 202 is substantially equal to the cross sectional area of the muffler pipe 20 along the transmission direction, such that the air flowing into the muffler pipe 20 may not be unstable (i.e. pressure or flow speed) due to the variation of the cross sectional area. Accordingly, the cross sectional area of the muffler pipe 20, the opening 202 of the muffler pipe 20, and the opening 1226 of the sidewall 122 are associated. Thus, in fabrication process, a user can design a muffler pipe with suitable structure and opening.

In the present disclosure, the purpose of the design of the intersection of the long side surface SS2 and the short side surface SS1 is: once the air flows into the muffler pipe 20, the long side surface SS2 with arc shape may reflect the air into the muffler pipe 20. Such design can prevent the airflow from reflecting back into the channel 15. Thus, the design provides a more concentrated airflow in the muffler pipe 20.

The shaft 162 of the fan 16 has a center O. The center O extends to a first direction D1 along the x-axis. In the present disclosure, the first direction D1 is parallel to the bottom edge of the bottom case 126. The center O extends to a second direction D2 from the center O toward the opening 1226 of the sidewall 122. The first direction D1 and the second direction D2 define an angle θ therebetween. In some embodiments, the angle θ is 120 degree. In some other embodiments, the angle θ may be 60, 80, 100, 140 to 180 degrees, or any suitable degrees. In fact, the angle θ depends on the position of the opening 1226 of the sidewall 122.

In the present disclosure, the reason for designing the opening 1226 on the sidewall 122 and disposing the muffler pipe 18 on the sidewall 122 is: since the airflow in the channel 15 between the sidewall 122 and the fan 16 is static and concentrated, the airflow may be easily directed into the muffler pipe 19 disposed on the sidewall 122 and further reducing the noise caused by the blade passing frequency. Besides, in fabrication process, since different fans have various structures, the position of the opening 1226 may be selected according to experiment results.

The present disclosure provides a centrifugal fan structure having a top case, a body, a fan, and a muffler pipe. The muffler pipe is disposed on a sidewall of the body, and an opening of the muffler pipe corresponds to an opening of the sidewall. Since a channel of the body has stable and concentrated airflow, the air may better flow into the muffler pipe disposed on the sidewall to reduce noise from blade passing frequency.

Besides, the muffler pipe of the present disclosure may be a quarter-of-wavelength pipe. Due to a destructive interference between an incident wave and a reflective wave, noise reduction may be achieved.

The muffler pipe may include rigid or hard materials, such that the airflow may be completely reflected without being destroyed. The muffler pipe may include flexible materials, such that the muffler pipe may be slightly bended to fit an insufficient space in a computer.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A centrifugal fan structure, comprising:

a top case comprising an air inlet;

a body comprising a sidewall, a tongue portion, and a bottom case, wherein the sidewall and the tongue portion are disposed on the bottom case, and the sidewall comprises an opening;

a fan disposed in the body, wherein the fan comprises a shaft and a plurality of blades connected to the shaft; and a muffler pipe disposed on the sidewall of the body, and comprising an opening corresponding to the opening of the sidewall of the body, a first side surface disposed along the sidewall of the body, a second side surface opposite to the first side surface, a top surface and a bottom surface disposed at a top side and a bottom side of the muffler pipe, and an end surface disposed at one end of the muffler pipe distal to the opening of the muffler pipe along a long axis of the muffler pipe, wherein the end surface is formed as a wall and extends between the first side surface and the second side surface, and between the top surface and the bottom surface to fully close said one end of the muffler pipe distal to the opening of the muffler pipe along the long axis of the muffler pipe, wherein the fan has a steady state rotation speed under operation, a length of the muffler pipe is substantially equal to a quarter of a wavelength of a blade passing frequency of the fan, and wherein the blade passing frequency is a product of the steady state rotation speed of the fan and a number of the blades, and the wavelength is equal to a sound speed divided by the blade passing frequency.

2. The centrifugal fan structure of claim 1, wherein the opening of the muffler pipe and the corresponding opening of the sidewall are substantially of the same size.

3. The centrifugal fan structure of claim 1, wherein the opening of the muffler pipe is disposed at an edge of the short side surface.

4. The centrifugal fan structure of claim 1, wherein a profile of the short side surface fits a profile of the sidewall.

5. The centrifugal fan structure of claim 1, wherein the long side surface and the short side surface are intersected at another end of the muffler pipe along the long axis, and the opening of the muffler pipe is disposed at the short side surface.

6. The centrifugal fan structure of claim 5, wherein the opening of the muffler pipe and the corresponding opening of the sidewall are substantially of the same size.

7. The centrifugal fan structure of claim 5, wherein the opening of the muffler pipe is disposed at an edge of the short side surface.

8. The centrifugal fan structure of claim 5, wherein a profile of the short side surface is conformal with a profile of the sidewall.

9. The centrifugal fan structure of claim 5, wherein the muffler pipe and the body are formed integrally in one piece.

10. The centrifugal fan structure of claim 5, wherein the muffler pipe is detachably disposed on the body.

11. The centrifugal fan structure of claim 5, wherein the muffler pipe is made of plastic.

12. The centrifugal fan structure of claim 5, wherein the muffler pipe is made of rubber or soft plastic.

13. The centrifugal fan structure of claim 5, wherein:

a first direction is parallel to a bottom edge of the bottom case and passes through a center of the shaft, a second direction is extended from the center of the shaft toward the opening of the sidewall, and the first direction and the second direction form a 120-degree angle between the first direction and the second direction.

14. The centrifugal fan structure of claim 5, wherein an intersection of the long side surface and the short side surface contacts the body.

15. The centrifugal fan structure of claim 5, wherein the muffler pipe has five surfaces.

16. The centrifugal fan structure of claim 5, wherein a profile of the muffler pipe is conformal to the sidewall of the body.

17. The centrifugal fan structure of claim 1, wherein the muffler pipe is free of additional openings in addition to the opening of the muffler pipe.

18. The centrifugal fan structure of claim 1, wherein the opening of the muffler pipe is the only entrance and exit for air.

* * * * *